United States Patent [19]

Delwig et al.

[11] Patent Number: 4,809,954

[45] Date of Patent: Mar. 7, 1989

[54] LOOP CARRIAGE

[75] Inventors: Friedrich W. Delwig, Hilden; Dieter Schoenert, Bochum, both of Fed. Rep. of Germany

[73] Assignee: Mannesmann AG, Duesseldorf, Fed. Rep. of Germany

[21] Appl. No.: 13,650

[22] Filed: Feb. 12, 1987

[30] Foreign Application Priority Data

Feb. 14, 1986 [DE] Fed. Rep. of Germany ..... 3605167

[51] Int. Cl.[4] ..... B65H 20/34

[52] U.S. Cl. ..... 254/286; 254/387

[58] Field of Search ..... 254/387, 382, 385, 386, 254/278, 286, 283

[56] References Cited

U.S. PATENT DOCUMENTS 172,896 2/1876 Stekins ..... 254/386 X
706,962 8/1902 Kubierochky ..... 254/278
4,111,398 9/1978 Alexander ..... 254/382 X
4,473,010 9/1984 Dietz ..... 254/387 X

FOREIGN PATENT DOCUMENTS 1335659 10/1973 United Kingdom ..... 254/278

*Primary Examiner*—Stuart S. Levy
*Assistant Examiner*—Katherine Matecki
*Attorney, Agent, or Firm*—Ralf H. Siegemund

[57] ABSTRACT

A carriage cooperates with a cable way machine with an oblique multigroove pulley and a friction drive drum, so oriented that the cable runs in straight directions off and onto circular grooves of the drum. One cable portion runs from the cable way machine through the carriage towards a fixed anchoring point, the remaining cable portion runs also through the carriage to a tension biasing anchoring point; function and configuration of a main cable and of a hauling cable are thus combined.

1 Claim, 3 Drawing Sheets

(A-A)

LOOP CARRIAGE

BACKGROUND OF THE INVENTION

The present invention relates to a so-called loop drive wherein a carriage is provided for guiding a ribbon tape or strip and is itself moved through an arrangement of ropes or cables. The cable has one end anchored to a stationary point and is deflected by means of pulleys or the like and is run to the carriage to be driven and back to a winch. On turning the winch for unwinding or taking up the cable, the carriage is moved in one direction or the other.

It was found to be a disadvantage that in such a drive system the cable moves laterally upon winding and unwinding from the winch while a particular take-up angle has to be maintain between the winch and the cable. Another disadvantage is to be seen that in case of a fast movement of the carriage, particularly towards the winch, or if for some reason the ribbon suddenly breaks, the carriage may be run against a baffle or bumper without prior breaking, which may lead to damage in the carriage or other equipment.

In order to avoid the aforementioned drawbacks, it is known to guide the carriage by means of a main or tension cable and to provide separately a capturing or hauling cable. The principle and tension cable will run over pulleys to the side of the carriage facing away from the ribbon, tape or strip while the capturing or hauling cable is run through rollers to the side or end of the carriage manipulating the ribbon, there being still another deflection pulley for running this capturing cable also to the winch. This arrangement has the advantage that owing to the combination of a tension cable and of a hauling or capturing cable, the carriage can be guided very accurately that means in any direction and it can actually be driven to and stopped at a particular point. However, it is a disadvantage that even here a winch is needed which has to take up the principle or tension cable as well as the capturing cable.

DESCRIPTION OF THE INVENTION

It is an object of the present invention to provide a new and improved drive for the carriage of the type referred to above being of simplified construction and configuration but maintaining the principle of a capturing and hauling cable for the carriage.

In accordance with the preferred embodiment of the present invention, it is suggested to associate the drive with a cable way machine which includes a deflection pulley and a drum arranged in spaced apart relationship and wherein one of them is rotating in a plane situated oblique to the plane rotation of the respective other one, such that cable is run by the oblique plane towards and from axially and azimuthally spaced points in different relation to different grooves of the drum and that this cable way machine is held by the principle tension cable as well as by a hauling capturing cable, whereby actually these cable are one and the same; they, so to speak, merge in the cable way machine.

The inventive construction has the advantage of using a cable way machine so that there is no longer any need for a winch taking up or passing the cable. Rather, the carriage is, in fact, driven by the cable way machine having a drive drum in frictional engagement with the cable. The counterforce necessary in such a friction drive is provided through the same cable namely the capturing and hauling cable which is fastened to the other side of the carriage, and runs from there to the tensioning piston cylinder drive. The same cable runs from the cable way machine as tension cable through the carriage at the other side and to a fixed anchor point. The carriage is, in fact, maintained in a captured and held relation but can be guided to every point whereby it is required to avoid, as a principle feature, a winch. This means that lateral cable deflections are avoided, they are inherent in the function of a winch outlined above. Finally, it should be mentioned specifically that not only is the construction of the drive simplified, it is also considerably more economical.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE DRAWINGS

Figure 1:
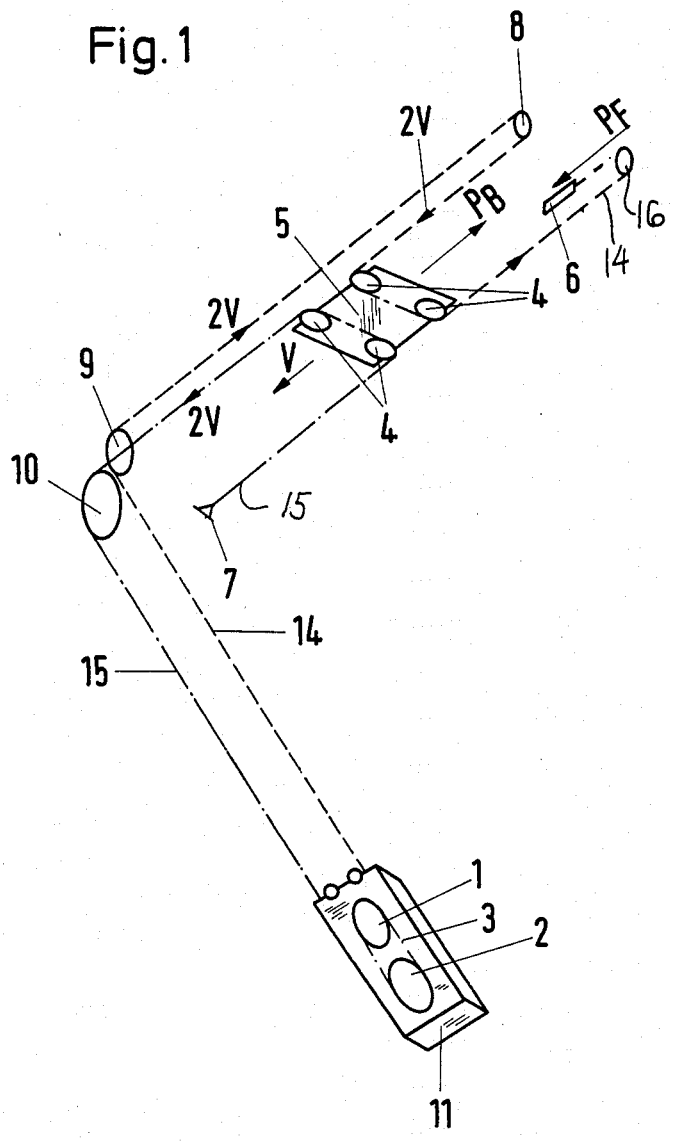
FIG. 1 illustrates somewhat schematically and basically the cable which extends and is guided in between a loop drive carriage and a cable way machine.
Figure 2:
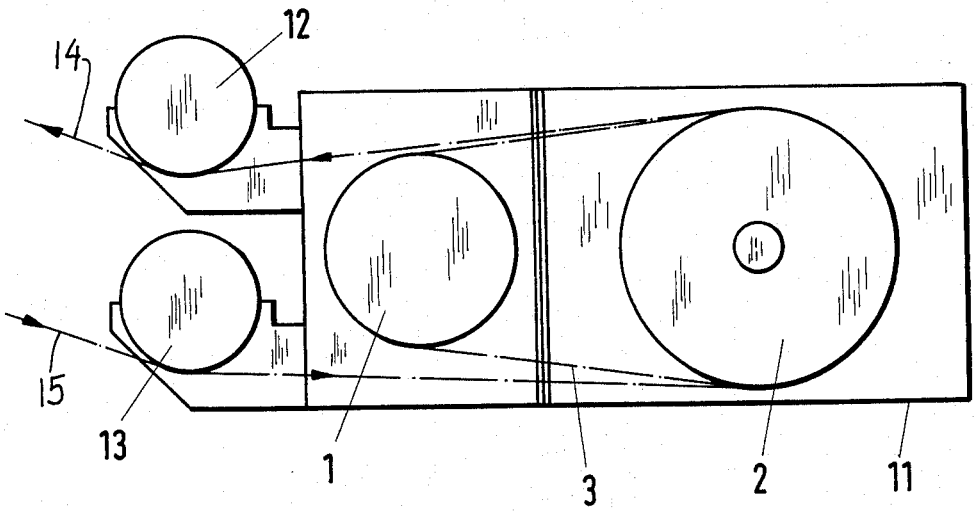
FIGS. 2 and 3 are schematically respectively top and side elevations of the cable way machine shown already in FIG. 1.
Figure 3:
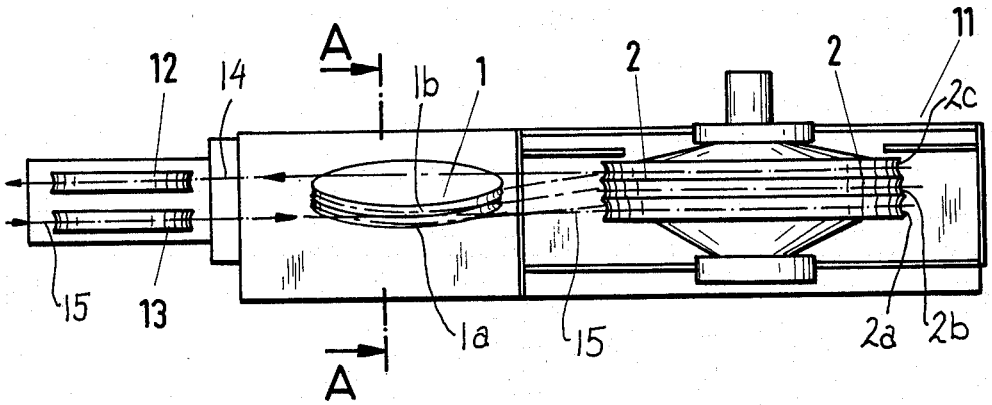

FIG. 1 illustrates schematically the basic layout for the cable asit extends between a loop carriage 5 and the cable way machine 11. The carriage 5 is provided to hold a particular ribbon, tape or strip which, at this point, is not illustrated. The arrow PB is next to the ribbon and indicates the ribbon tension. This carriage 5 is provided with deflection pulleys or sheaves which, on one hand, are provided for guiding the capturing and hauling cable 14, while on the other hand, the principle cable 15 is accommodated by other sheaves or pulleys. The capturing and hauling cable 14 is supported under utilization of a pneumatic piston cylinder drive 6. The cable 14 in the illustrated example is run from the tensioning drive 6 via a pulley 16 into carriage 5 (sheaves 4), out again through further deflection sheaves or pulleys 8 and 9 into the cable way machine 11, particularly a roller 12 thereof, by means of which that particular cable 14 is connected to the cable way machine. Details of that connection will be described shortly.

As stated the principle tensioning cable 15 is run through deflection pulleys 4 on the carriage 5 and is held at a fixed point or stationary frame and support point 7. In the illustrated example, this tension cable 15, moreover, runs from the carriage 5 via a sheave on pulley 10 to a roller 13 on into the cable way machine 11. The cable way machine 11 is provided with a first deflection pulley or roller 1 and drive roller or drum 2.

Figure 4:
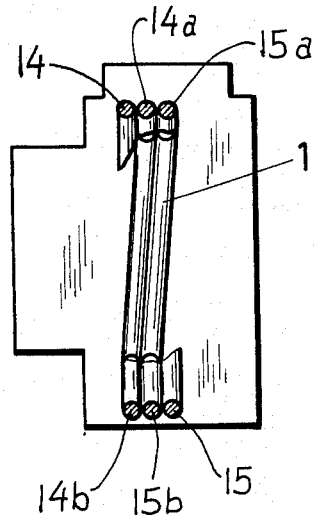
FIG. 4 is a schematized section view belong lines A—A in FIG. 3.

The deflection sheave or pulley 1 on the cable way machine is provided in a particular orientation in relation to the drive roller or drive drum 2. This is shown in greater detail in FIG. 4. Basically, one can say that the pulley 1 and the drum 2 have planes of rotation which are inclined in relation to each other. However, it is more appropriate to consider the plane of rotation for the drive roller 2 to establish the principle plane vis-a-vis the system as a whole, and the deflection sheave or pulley 1 is then obliquely oriented to that principle plane of reference of roller or drum 2. The purpose of this orientation is to run the cable onto the friction drive drum 2 or taking cable therefrom respectively in and from different grooves, the drum 2 is not acting as a winch; there is, so to speak, always the same amount of cable engaged by that drum 2.

Considering the situation in some detail, cable 15 is run by pulley 13 into the machine 11, by passing deflector pulley 1, and is run straight onto a circular groove 2*a* of drum 2. The cable loops up in a plane that is at right angles to the axis of rotation of drum 2, and is run back (stringer 15*a*) directly above the incoming stringer 15 but owing to the oblique position of the pulley 1, stringer 15*a* is taken up by a groove 1*a* of pulley 1, loops around but follows the oblique orientation of pulley 1, and leaves as axially displaced stringer 15*b*, towards the middle groove 2*b* of drum 2. Stringer 15*b* now loops around that middle loop, and, one may say, now "becomes" cable 14 because, in fact, these two cable are one and the same.

The cable is run into groove 1*b*, as stringer 14*a* loops back as stringer 14*b* into groove 2*c*, and leaves the machine as cable 14, by-passing pulley 1. It can be seen that the terminology chosen: main/tension cable and capturing/hauling cable is for reasons of distinction of different cable portions. In essence, they are one and the same cable.

This multiple looping, of course, establishes a friction drive or, better, a frictional driving connection between the drive drum or roller 2 and the cable 14/15. Moreover, the usual winch which was customary in known equipment, is avoided. One can see that the carriage 5 is, on the one hand, normally connected to the main pulley cable 15 and for safety reasons and hauling it is held in addition by the capturing and hauling cable 14.

As cable 14 and 15 move at a speed 2V, carriage 5 moves with speed V; the arrows denote the respective direction. PB and PF denote, respectively, cable tension and force on drive 6.

The invention is not limited to the embodiments described above, but all changes and modifications thereof, not constituting departures from the spirit and scope of the invention are intended to be included.

We claim:

1. A drive for a loop carriage which is provided for guiding and pulling a ribbon, tape or strip, comprising in combination:

a cable way machine associated with the carriage including a friction drive drum and a spaced-apart deflection pulley, each having a plane of rotation, the respective planes of rotation being obliquely oriented to each other, the deflection pulley having a helical groove, the drive drum having multiple, parallelly oriented circular grooves; a cable looping around the drive drum and the deflection pulley back and forth between the helical groove of the deflection pulley and the circular grooves of the drive drum, so that there is take-up of the cable and pay-out of the cable in different regions of the drive drum, the regions correspnding to different grooves of the drive drum; to run from the cable having first and second portions, each running from the cable way machine to the loop carriage;

means for connecting one end of the cable to a fixed point;

means including a piston cylinder drive connected to an opposite end of the cable for tension biasing; and the cable being guided through and held by pulleys in and on the loop carriage, and comprising a third cable portion running from the loop carriage towards the one fixed end of the cable, and a fourth cable portion connected to said opposite end running from the carriage, in a direction opposite the third portion, to said tension biasing means.

* * * * *